US007308727B2

(12) United States Patent
Pidlysny

(10) Patent No.: US 7,308,727 B2
(45) Date of Patent: Dec. 18, 2007

(54) POLISHING SYSTEM AND TOOL

(76) Inventor: Bill Pidlysny, P.O. Box 1317, Barrie, On. (CA) L4M 5R4

( * ) Notice: Subject to any disclaimer, the term of this patent is extended or adjusted under 35 U.S.C. 154(b) by 318 days.

(21) Appl. No.: 11/195,598

(22) Filed: Aug. 3, 2005

(65) Prior Publication Data

US 2007/0028408 A1 Feb. 8, 2007

(51) Int. Cl.
*B08B 1/04* (2006.01)

(52) U.S. Cl. ..... 15/104.095; 15/230; 15/230.19; 451/359

(58) Field of Classification Search ..... 15/104.03, 15/104.04, 104.05, 104.09, 104.095, 230, 15/230.19; 451/359, 508, 548, 549
See application file for complete search history.

(56) References Cited

U.S. PATENT DOCUMENTS 5,123,763 A * 6/1992 Simmons ..... 401/9

* cited by examiner

*Primary Examiner*—Mark Spisich
(74) *Attorney, Agent, or Firm*—D. W. Eggins; D. Eggins

(57) ABSTRACT

A rotary tool used with a pneumatic or an electric drill, for polishing truck wheels, adjacent the in-situ nuts, has a chuck mounted on a driving shaft, the chuck including an outer cylindrical housing, a centre housing with a replaceable guide bushing, and an annular interior passage containing a projecting flexible, fabric polishing sleeve. The guide bushing slides in centering relation over a wheel nut. The annular fabric sleeve protrudes beyond the front of the tool, and radially outwardly, to engage and polish the skirt of the nut and a surrounding portion of the wheel, with pre-applied polishing compound.

12 Claims, 1 Drawing Sheet

POLISHING SYSTEM AND TOOL

CROSS-REFERENCE TO RELATED APPLICATIONS

Not Applicable (N/A)

STATEMENT REGARDING FEDERALLY SPONSORED RESEARCH OR DEVELOPMENT (N/A)

REFERENCE TO A "SEQUENCE LISTING" A TABLE, OR A COMPUTER PROGRAM LISTING APPENDIX (N/A)

BACKGROUND OF THE INVENTION

Field of the Invention

This invention is directed to a polishing system for polishing surfaces having protruberant items projecting therefrom, and located in space-restricted environments, and in particular to a tool and system for polishing in-situ the wheels of vehicles in close proximity to their wheelnuts.

The legal requirement to provide daily inspection and checking of the secured condition of the wheel nuts of highway tractors and their trailers has placed great emphesis on the desirability of maintaining the surfaces of the wheels, particularly in proximity to their wheel nuts, in a clean and polished condition. Also, the owners and operators of such 'rigs' like to maintain them to a high standard of appearance, with highly polished aluminum wheels to impede corrosion and to show up any defects in the wheel.

Prior to the present invention, the areas of the wheel surface adjacent the wheel nuts were usually polished by hand, using cloths and cleaning and polishing compounds. Quite apart from being labour-intensive and time-consuming, this process was also extremely hard on the hands of those doing the cleaning and polishing.

BRIEF SUMMARY OF THE INVENTION

The present invention provides a rotary tool for use with a powered machine such as a pneumatic (air driven) or an electric drill, the tool having a chuck portion rotatably mounted on a polar-oriented driving shaft, the chuck portion including an outer cylindrical sleeve that serves as a containment housing, a centre housing containing a replaceable guide bushing, and an annular aperture between the bushing and the housing to receive a flexible, fabric polishing sleeve in entered relation therein.

In use, the guide bushing is sized diametrically to slide in centering relation over a wheel nut, to serve as a journal bearing, running on the apices of the wheel nut flats.

This guide sleeve may be of nylon or other suitable, hard-wearing plastic.

The annular space between the removable sleeve and the centre housing is sized to receive a fabric sleeve in substantially contained relation therein, having the axially outer end of the sleeve protruding a predetermined distance beyond the edge of the containment housing. This outer end portion of the sleeve is formed as a protruding annular roll, extending radially outwardly beyond the tool, to contact the surrounding wheel surface. The fabric sleeve may be of non-abrasive or of abrasive material.

The chuck portion is mounted by screw threads to the driving shaft, and may be provided with locking means to secure it.

The centering guide bushing is mounted coaxially within the chuck portion, being a push fit within its recess, for purposes of ready replacement.

In use, with the protective domed nut covers removed, a polishing compound is applied to the wheel areas surrounding the nuts, or to the outer end of the polishing sleeve, and with the tool mounted in the chuck of a power tool such as an air driven or an electric drill, the guide bushing is applied over a selected nut and the polishing sleeve brought into rotating, polishing relation with the area surrounding the nut, and the nut skirt.

BRIEF DESCRIPTION OF THE SEVERAL VIEWS OF THE DRAWINGS

Certain embodiments of the invention are described by way of illustration, without limitation thereto other than as set forth in the accompanying claims, reference being made to the accompanying drawings, wherein:

DETAILED DESCRIPTION OF THE INVENTION

It will be understood by those skilled in the art that the above disclosure is directed primarily to specific embodiments of the present invention, and that the subject invention is susceptible of reduction to practice in other embodiments that fall within the scope of the appended claims.

Figure 1:
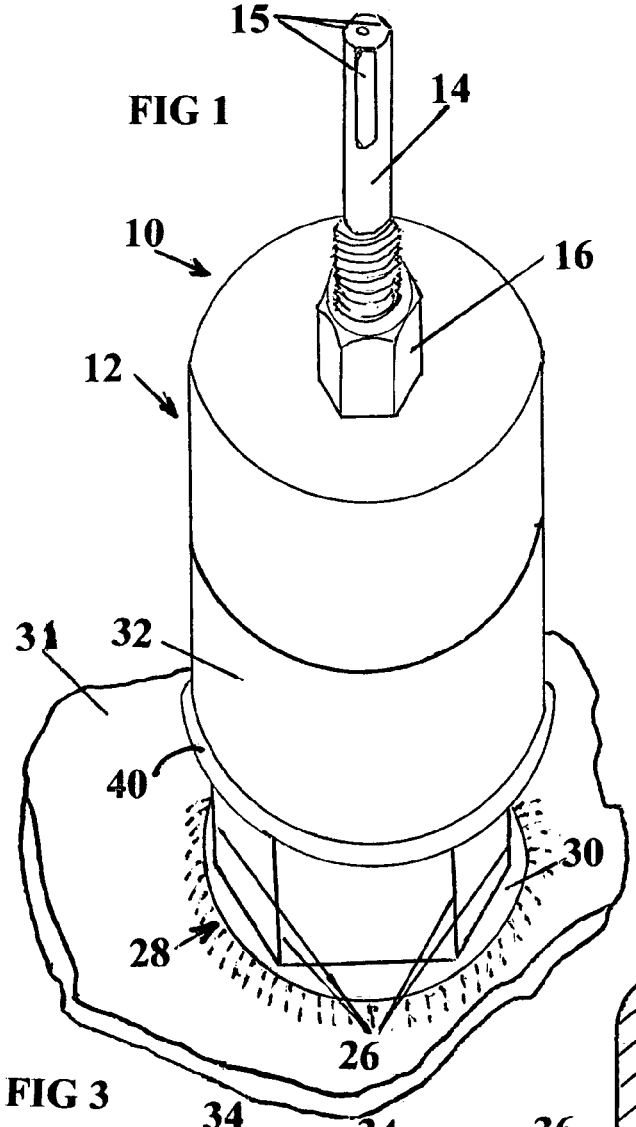
FIG. 1 is a perspective view of an embodiment of a polishing tool in accordance with the present invention, in partially inserted relation over a vehicle wheel nut.
Figure 2:
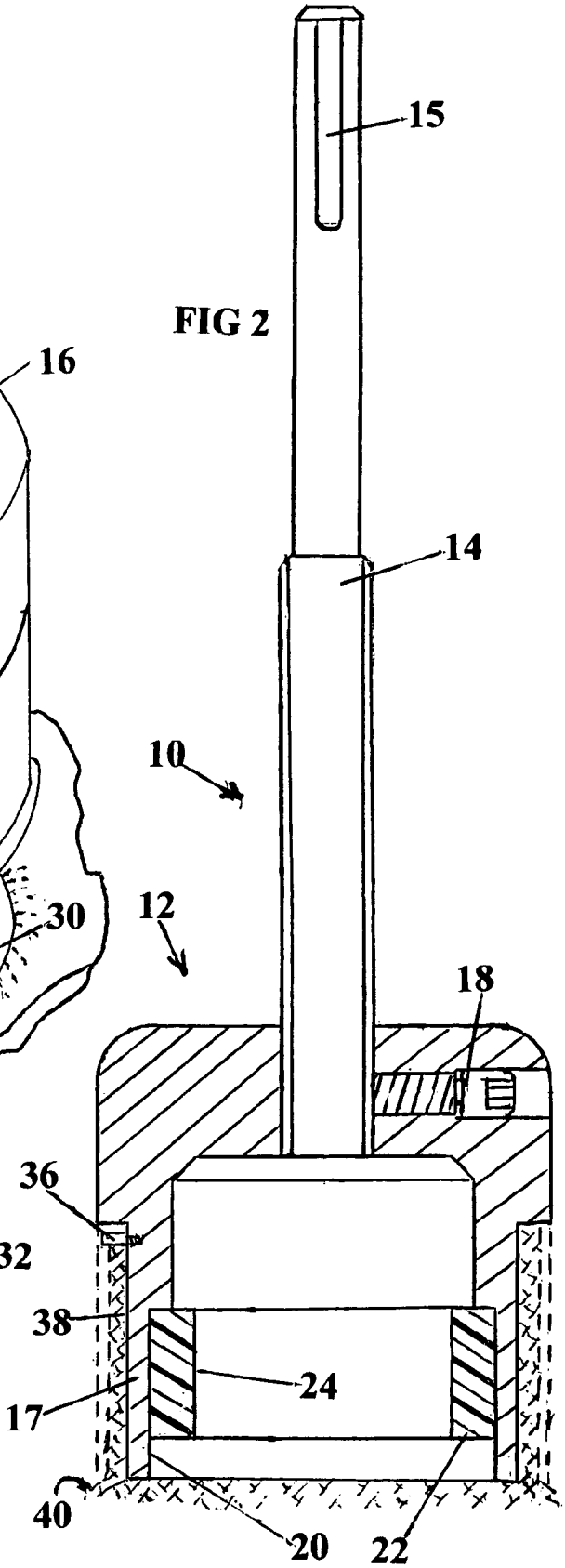
FIG. 2 is a diametrical section of the elements of the subject tool, with the outer sleeve containment housing being shown in dotted line; and, FIG. 3 is a diametrical section of the outer sleeve containment housing.
Figure 3:
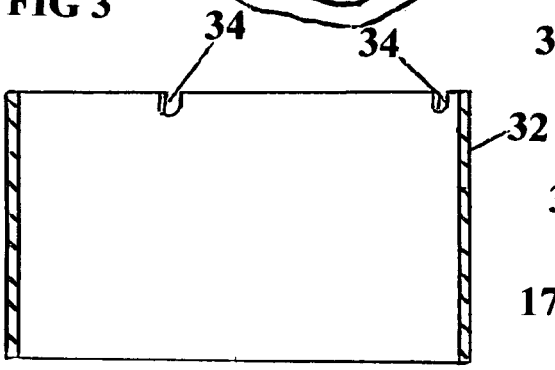

Referring to FIGS. 1 and 2, a polishing tool 10 in accordance with the present invention has a chuck portion 12 threadedly attached to a driving shaft 14, being illustrated in FIG. 1 with a locking nut 16, and a threaded housing with a grub screw 18, as alternative locking means, shown in FIG. 2.

The driving shaft 14 has three end flats 15, for engagement with the chuck of a driving tool such as a pneumatic or electric drill (not shown), which power tool does not form a part of the present invention.

The tool chuck 12 has a cylindrical end portion 17 of reduced diameter, with an interior recess 20 containing a replaceable plastic guide bushing 22. The central bore 24 of the bushing 22 is diametrically sized to revolve about the edges 26 of a truck wheelnut 28. These wheelnuts 28 have a bevelled annular flange portion 30 to engage an aluminum truck wheel, of which a portion 31 is shown in FIG. 1.

The cylindrical containment housing, sleeve 32 is illustrated with slots 34, 34 at its upper edge, to receive driving pins 36, which extend radially outwardly from the chuck 12.

A fabric sleeve 38 of material, such as a selected grade of "Scotchbrite" (T.M.), or buffing cloth, which includes both abrasive and non-abrasive fabrics, is located within the sleeve 32 and serves to retain the sleeve 32 coaxially upon the chuck end portion 17.

The sleeve 38 extends beyond the front of the tool 10, being compressed and wadded at 40 so as to extend radially primarily outwardly into polishing relation with the flange portion 30 of wheelnut 28, and the surrounding annular surface of the wheel.

In use, a polishing compound may be applied to the wadded portion of sleeve 38, or to the wheel surface surrounding the nut 28, and the tool 12 energized by switching on the associated drive drill, and the tool 12 then slid into engagement with the nut 28, in polishing engagement with the nut flange portion 30 and its immediate surrounding wheel area.

It has been found that a mirror polished finish may be readily achieved, such that any defect or imperfection of the wheel adjacent a nut 28 is readily apparent. Also, the formation of corrosion or oxidation is impeded. The remaining surface of the wheel is readily polished, using well-known materials and methods.

It is contemplated that the illustrated driving pins 36 by which the sleeve 32 is positively driven may not prove to be essential for the satisfactory operation of the tool 10.

The use of an elasticated buffing cloth, or of an elastic band, is contemplated, the elasticated cloth being stretched in fitting relation over the chuck portion of the machine, or the elastic band being applied in compressive relation about the fabric sleeve 38, to secure it in driven relation with the chuck end portion 17, in place of the outer sleeve 32.

The invention claimed is:

1. A rotary polishing tool for polishing surfaces located around local protruberances, said tool having a driving shaft, chuck means secured to said shaft for rotation therewith; hollow guide bushing means within said chuck means to receive a said protruberances in entered, substantially centered relation therein; sleeve means secured to said chuck means for rotation therewith, having an end portion of said sleeve means projecting outwardly of said chuck means, in use, upon rotation of said tool and entry of said protruberances within said chuck, said sleeve means being enabled to make contact with selected portions of said surfaces, in polishing relation therewith.

2. The polishing tool as set forth in claim 1, said chuck means including a removable housing portion located in partially enclosing relation with said sleeve means.

3. The polishing tool as set forth in claim 2, said chuck means including a central body portion; driving means connecting said central body portion with said removable housing portion, in torque transfer relation therewith.

4. The polishing tool as set forth in claim 1, said protruberant article consisting of an hexagonal wheel nut of a vehicle, said nut having six sides mutually convergent at six apices positioned about said nut and extending substantially parallel with said driving shaft; said guide bushing means being internally dimensioned to receive said nut apices in entered, centered running relation therein.

5. The polishing tool as set forth in claim 1, said chuck means being threadedly connected with said driving shaft.

6. The polishing tool as set forth in claim 1, including adjustable locking means securing said chuck means to said driving shaft.

7. The polishing tool as set forth in claim 6, wherein said adjustable locking means is a locking nut threadably mounted upon said driving shaft.

8. The polishing tool as set forth in claim 6, wherein said adjustable locking means is a grub screw threadedly mounted within said chuck means to make immobilizing contact with said driving shaft.

9. The polishing tool as set forth in claim 1, said driving shaft being diametrically sized for attachment to a rotary machine.

10. The polishing tool as set forth in claim 9, said driving shaft having a plurality of shaped surfaces at the end thereof, for engagement with a chuck of said rotary machine.

11. The polishing tool as set forth in claim 10, said shaped surfaces comprising three flat surfaces substantially equally spaced about said shaft end.

12. The polishing tool as set forth in claim 1, said guide bushing means being a push fit within said chuck means.

* * * * *